US005740634A

United States Patent [19]

Schade

[11] Patent Number: 5,740,634

[45] Date of Patent: Apr. 21, 1998

[54] SEALING STRIP FOR A ROOF RIDGE OR ARRIS COVER

[75] Inventor: Kurt Schade, Wildeshausen, Germany

[73] Assignee: Ing. Kurt Schade GmbH & Co., Wildeshausen, Germany

[21] Appl. No.: 726,162

[22] Filed: Oct. 4, 1996

[30] Foreign Application Priority Data

Oct. 6, 1995 [DE] Germany ..... 195 37 266.2

[51] Int. Cl.[6] ..... B61D 17/14

[52] U.S. Cl. ..... 52/43; 52/199

[58] Field of Search ..... 52/41–44, 198, 52/199, 302.1, 90.1

[56] References Cited

FOREIGN PATENT DOCUMENTS 88 16 544.2 1/1990 Germany .
38 16 015.3 5/1991 Germany .
295 01 242.0 4/1995 Germany .
43 33 247.1 4/1995 Germany .
295 04 197.8 6/1995 Germany .

*Primary Examiner*—Carl D. Friedman
*Assistant Examiner*—Beth Aubrey
*Attorney, Agent, or Firm*—Collard & Roe, P.C.

[57] ABSTRACT

A sealing strip for a roof ridge or arris cover, made of soft, easily deformable material and having a center strip zone disposed between lateral strip zones. The center strip zone is adapted for placement on a roof ridge or arris plank and is air permeable. The lateral strip zones are adapted for placement on the top sides of roof cover boards. The center strip zone comprises a center section coming to rest on the roof ridge or arris plank and side strip sections which are sieve-like and air permeable. The adjoining lateral zones are pleated, with the pleating aligned substantially perpendicular to the longitudinal axis of the sealing strip.

17 Claims, 3 Drawing Sheets

SEALING STRIP FOR A ROOF RIDGE OR ARRIS COVER

BACKGROUND OF THE INVENTION

1. Field of the Invention

The invention relates to a sealing strip for a roof ridge or arris cover, having a center strip zone disposed between lateral strips, the center strip zone being adapted for placement on a roof ridge or arris plank and being permeable to air, whereby the outer longitudinal edges of the lateral strips are adapted for placement on the top sides of roof cover boards adjacent to a roof ridge or arris of a roof.

2. The Prior Art

Sealing strips of the type specified above are known. These strips have cover caps which serve to close a roof ridge or roof arris in order to scal the interior space of the roof or hollow spaces of the roof insulation against rain and snow and to ensure the ventilation and exhaust of such spaces.

In German Patent No. 38 16 015, the center zone of the strip, which comes to rest on the roof ridge or arris plank, is made from a fleece which, because of its fine porosity, is permeable to air and at the same time seals against rain and snow. The roof cover boards laid adjacent to the roof ridge or arris plank usually have an uneven surface. In order for the sealing strip to be placed against the top sides of such roof bricks with permanent tightness, which is not possible with the fleece, lateral zones consisting of soft, expandable polyisobutylene foils are attached on either side of the fleece sealing strip.

To increase mechanical strength, the known sealing strip has a core layer consisting of a strip of expanded metal. In the center of the strip, the core layer is joined with the fleece, and is joined on the edges of the strip with polyisobutylene foil. The different materials must be suitably prepared before they can be used in the actual production process for the manufacture of the sealing strip. This makes the manufacture of the known sealing strip relatively expensive.

SUMMARY OF THE INVENTION

It is therefore an object of the present invention to overcome the drawbacks of the prior art and to create a sealing strip which seals and ensures proper ventilation and which can be easily and economically manufactured.

It is yet another object of the present invention to create a sealing strip which can be laid by hand or with the simplest means, and which is universally and permanently adaptable to roof cover boards.

According to the invention, the problem is solved by a sealing strip composed of a soft, plastic, easily deformable material having a center zone for placement on a roof ridge or arris plank. The center zone comprises a center section and two side sections which are sieve-like and permeable to air. The strip further comprises lateral zones adjoining each permeable section which are profiled in a pleated-like manner. The pleats are arranged substantially perpendicular to the longitudinal axis of the sealing strip.

The sealing strip can be easily manufactured using a unitary, soft material, because both the sieve-like production of the air permeable strip section and the pleating can be carried out with relatively simple machines. This advantageously permits an endless production of a sealing strip from a coil of a ribbon of the soft material. The finished sealing strips can be cut to size and wound up. Such a coil can then be easily handled on the roof ridge or arris, and the sealing strip can be installed in the roofing as it is being unwound from the coil.

The soft material makes the sealing strip easily deformable by hand, particularly where the pleating exists and is therefore easily adaptable to profiled roof cover boards. The pleating permits an expansion of the sealing strip of from 30% to 40% in the longitudinal direction. The deformation of the sealing strip produced by pressure as it is being fitted to the roof cover boards remains permanent because of the sealing material's plasticity. The sealing strip can therefore be installed quickly and inexpensively.

Preferably, the section of the center zone of the strip that comes to rest on the roof ridge or arris plank is blank, i.e. does not have any sieve-like surface. The sieve-like shape is limited to those sections of the strip in which a flow of air takes place to ventilate and exhaust the interior space of the roof. This limit on the sieve-like portions keeps the manufacturing costs of the strip low. Furthermore, the blank section may also serve as a centering aid when the sealing strip is laid on the roof ridge or arris plank.

The permanent deformation and close fitting of the edges of the sealing strip is made possible by making the lateral zones of the strip adjacent to the sieve-like sections pleated. The folds of the pleating permit both an expansion and a compression of the lateral zones of the strip with little expenditure of force. It is therefore ensured that the sealing strip, which is pressed against the top sides of the contoured roof cover boards and, thereby, deformed, will tightly and permanently fit on the roof cover boards.

The pleats can be produced in the sealing strip with relatively simple mechanical means such as, for example, grooved rolls, stamping dies or the like. This process is easily done when the material used is soft and deformable and in the form of a thin ribbon or strip. The sieve-like design of the air-permeable strip sections can be easily manufactured, for example, by punching.

In a preferred embodiment, each hole in the sieve-like sections is formed in the shape of a collar passage projecting outwardly on one side. This collar passage can be formed at the same time that the holes are being produced with suitable punching dies. The collared passage reduces the air flow resistance, which promotes the exhaust flow of the air. The collar also prevents water from passing through a hole and into the interior space of the roof, because the hole has the rising collar edge.

So as to ensure adequate venting and exhausting of the interior space of the roof, the sieve-like sections must be air permeable. Permeability is achieved when the sum of the areas of the holes is equal to or greater than 0.5 0/00 of the roof area associated with the roof ridge or arris to be covered.

Copper sheeting is preferable as the soft material for the sealing strip. This material, because of its strength at a thickness of only about 0.1 to 0.2 mm, is both inexpensive and durable. Alternately, the sealing strip may be made from aluminum sheeting with a thickness from 0.2 to 0.3 mm. The sheets are preferably coated at least on one side with a dyed foil. The dyed foil permits the copper or aluminum sheets to have the same color as the roof cover boards. In addition, such a coating increases the resistance of the sheets to weathering. For example, a polymer foil can be used for the coating, which is applied to the sheets before they are perforated and pleated. For the purpose of coloring, the sheets may be also coated with a dyed compound.

Pleating is easily shaped in the sheets. To optimize the adaptability of the sealing strip to different roof surfaces, the pleating is divided in fields expanding fan-like toward the outer edge of the strip. The pleating has a length supply of 30% to 40%, which permits expansion as the strip is being pressed against the contoured roof cover boards.

The adhesion of the sealing strip to the top sides of roof cover boards can be accomplished by adhesive agents applied to the undersizes of the lateral zones of the strip which contact the roof cover boards.

The adhesive agent may be, for example, a self-adhesive coating. In the pleated zones of the strip, however, the adhesive is preferably an adhesive bead extending in the longitudinal direction of the strip. Commonly-used self-adhesive elastomers, for example, butyl rubber, can also be used as adhesive agents. A covering consisting of a removable protective strip is usefully placed over the applied adhesive. This covering prevents the adhesive from sticking when the sealing strip is coiled.

The sealing strip preferably has a width of about 280 to 320 mm, preferably of about 300 mm. The width of the lateral zones of the strip is least 70 mm, preferably 75 mm in each case.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
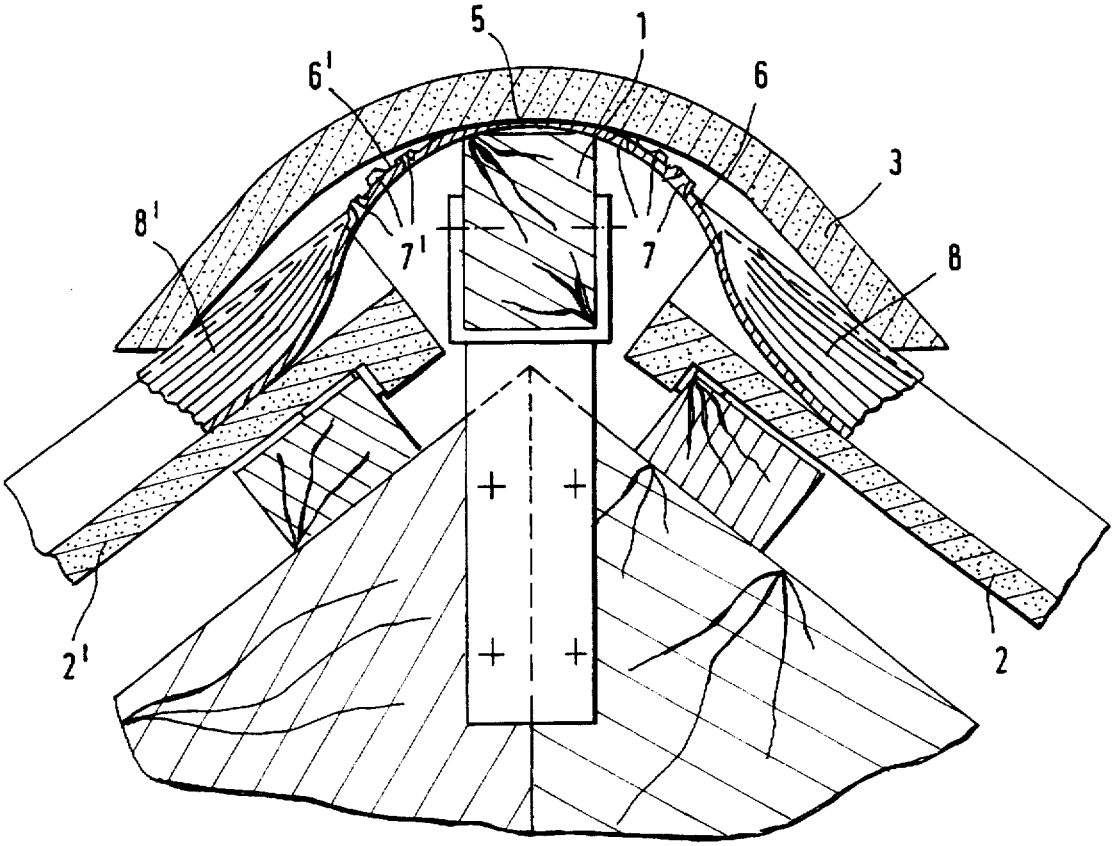
FIG. 1 is a cross-sectional view of a roof ridge with roof cover boards, a cover cap, and a sealing strip laid underneath.

Referring now in detail to the drawings and, in particular, FIG. 1, the roof ridge is shown in a cross-sectional view, with roof ridge plank 1, roof cover boards 2, 2', cover cap 3, and installed sealing strip 4. Sealing strip 4 consists of a soft, easily deformable material, for example, soft-annealed copper sheet or soft-annealed aluminum sheet material. Sealing strip 4 has a center strip zone comprising a section 5, which comes to rest on plank 1. Section 5 extends between strip sections 6 and 6'. Section 6 and 6' are designed sieve-like to be permeable to air. The holes in sieve-like strip sections 6 and 6' are denoted by 7 and 7'. Lateral strip zones 8 and 8' adjoining the outer edges of permeable strip sections 6 and 6', have a pleating aligned substantially perpendicular to the longitudinal axis of the sealing strip. In this way, sealing strip 4 can be easily fitted by pressing it against the contours of the top sides of roof cover boards 2 and 2'.

Figure 2:
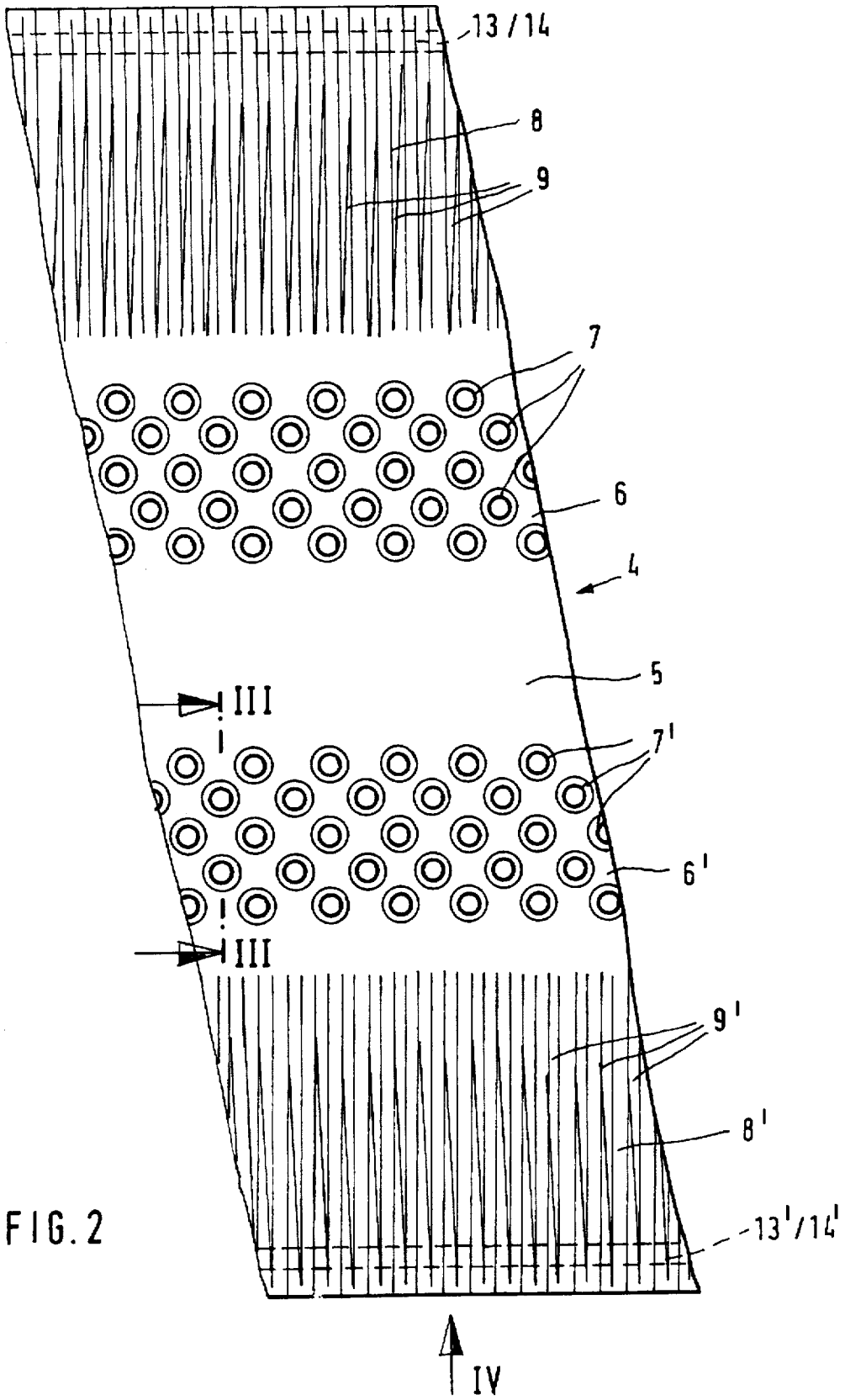
FIG. 2 is a top view of a section of the sealing strip.

FIG. 2 shows a top view of a section of sealing strip 4. FIG. 2 illustrates that the pleating is divided within itself in fields 9 and 9', which expand toward the outer edge in the way of a fan.

Figure 3:
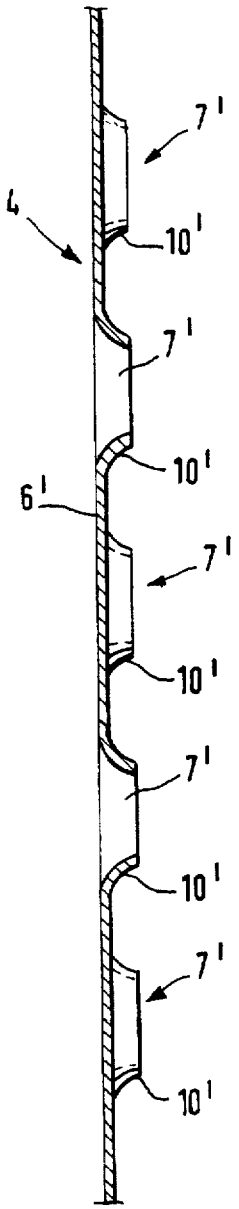
FIG. 3 is an enlarged view of a cross section of the sealing strip along line III—III in FIG. 2.

FIG. 3 shows an enlarged, schematic view of sieve-like designed strip section 6', with a section along line III—III of FIG. 2. As shown in FIG. 3, each hole 7' in sieve-like strip section 6' is designed in the form of a collar passage 10' projecting outwardly on one side. In this way, actual holes 7' are arranged raised above the plane of sieve-like strip section 6', so that precipitation water is prevented from passing through sieve-like strip section 6'. Furthermore, the nozzle-like designs of holes 7' promote the through-flow of air because the flow resistance is reduced as compared to a simple hole. Holes 7' in sieve-like strip section 6 are identically shaped.

Figure 4:
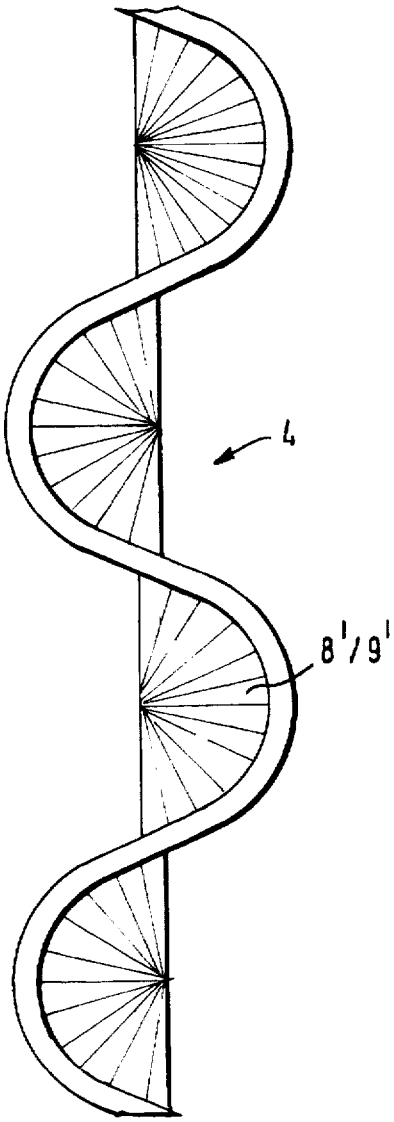
FIG. 4 is an enlarged view of the outer edge of the sealing strip viewed in the direction of arrow IV in FIG. 2.

FIG. 4 shows an enlarged schematic view of the outer edge of sealing strip 4 viewed in the direction of arrow IV in FIG. 2. As seen in FIG. 4, lateral zone 8' has fan-like pleating.

Figure 5:
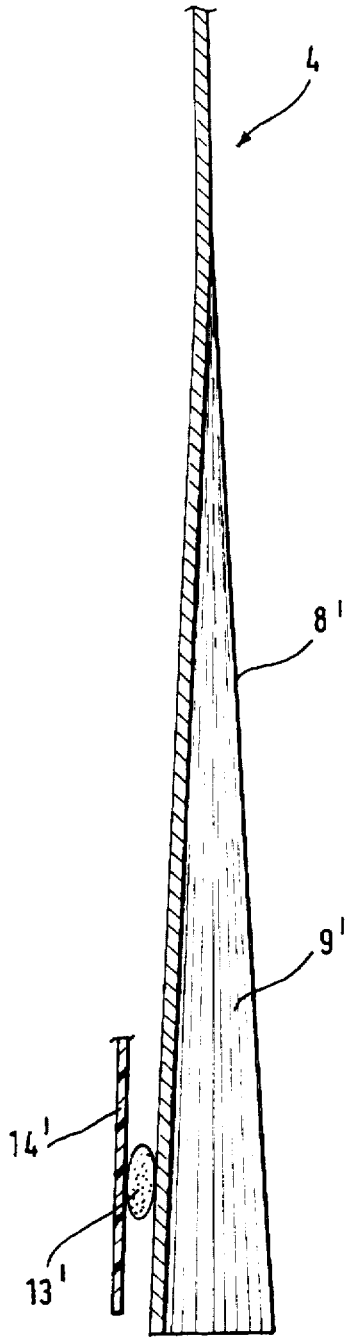
FIG. 5 is a sectional view of a lateral strip zone of the sealing strip.

FIG. 5 shows a schematic view of one half of sealing strip 4, in particular its lateral strip zone 8' showing the pleating in field 9'. As shown here, a coating with an adhesive agent 13' in the form of an adhesive bead extending in the longitudinal direction of the sealing strip is present near the outer edge of each lateral strip zone 8'. Adhesive bead 13' is covered by a protective strip 14', which can be peeled off.

The adhesive arrangement is also present on the opposite lateral strip zone 8 of sealing strip 4.

In operation, hot air that collects in the roof travels up to the sealing strip and exists through holes 7 and 7'. The hot air then travels underneath roof cover cap 3 and exists through the edges of roof cover cap 3. Collars 10' create a chimney-like effect that draws the hot air in the roof upward and through holes 7 and 7' to more effectively ventilate the roof.

Accordingly, while only several embodiments of the present invention have been shown and described, it is obvious that many changes and modifications may be made thereunto without departing from the spirit and scope of the invention.

What is claimed is:

1. An elongated sealing strip made of a single piece of soft, easily deformable material selected from the group consisting of copper and aluminum for mounting on a roof surface underneath a roof cover cap, and for sealing a roof ridge or arris cover, comprising:

a center strip zone comprising a longitudinally extending middle section and two longitudinally extending side sections integrally formed therewith, each of said two side sections having plurality of holes and being permeable to air for ventilating the roof, and said middle section lacking holes;

two longitudinally extending lateral strip zones, each lateral strip zone being integrally formed with one of said two side sections of said center strip zone and having an underside for contacting the roof surfaces and defining the outer edges of the sealing strip;

wherein the lateral strip zones are profiled in a pleated-like manner and wherein said pleating is arranged substantially perpendicular to the longitudinal axis of the sealing strip.

2. The sealing strip according to claim 1 further comprising an outwardly-extending collar surrounding each hole.

3. The sealing strip according to claim 1 wherein the sum of the areas of the holes is at least 0.50/00 of the area of the roof to be covered by the sealing strip.

4. The sealing strip according to claim 1 wherein the strip is made of copper sheeting.

5. The sealing strip according to claim 4 wherein the copper sheeting is about 0.1 to about 0.2 mm thick.

6. The sealing strip according to claim 1 wherein the strip is made of aluminum sheeting.

7. The sealing strip according to claim 6 wherein the aluminum sheeting is about 0.2 to about 0.3 mm thick.

8. The sealing strip according to claim 1 further comprising a dyed foil coating at least one side of the sealing strip.

9. The sealing strip according to claim 1 further comprising a dyed compound coating at least one side of the sealing strip.

10. The sealing strip according to claim 1 wherein the pleating is divided into fan-like fields that widen toward the outer edge of the sealing strip.

11. The sealing strip according to claim 1 further comprising an adhesive agent attached to the underside of each lateral side zone for adhering the strip to the roof.

12. The sealing strip according to claim 11 wherein the adhesive agent comparison at least one adhesive bead extending in the longitudinal direction of the strip.

13. The sealing strip according to claim 11, further comprising a removable protective strip covering the adhesive agent.

14. The sealing strip according to claim 1 wherein the strip has a width of about 280 to about 320 mm.

15. The sealing strip according to claim 14 wherein the strip has a width of 300 mm.

16. The sealing strip according to claim 1 wherein each lateral strip zone has a width of at least 70 mm.

17. The sealing strip according to claim 16 wherein each lateral strip zone has a width of 75 mm.

* * * * *